US005814172A

United States Patent [19]

Cox et al.

[11] Patent Number: 5,814,172

[45] Date of Patent: Sep. 29, 1998

[54] THERMOPLASTICS SHEETS FOR PROTECTING SUB-MARINE STRUCTURES

[76] Inventors: Arthur R. Cox, 6300 Rocking Horse Rd., Jupiter, Fla. 33458; Samuel M. Boszor, 9723 Heather Cir. E., Palm Beach Gardens, Fla. 33410

[21] Appl. No.: 677,689

[22] Filed: Jul. 8, 1996

[51] Int. Cl.[6] ..... B63B 59/04

[52] U.S. Cl. ..... 156/71; 114/222; 428/907

[58] Field of Search ..... 156/71, 309.6; 114/222, 67 R; 428/907

[56] References Cited

U.S. PATENT DOCUMENTS

| | | | |
|---|---|---|---|
| 3,761,334 | 9/1973 | Zondek | 156/71 |
| 4,035,546 | 7/1977 | Ruppert | 156/71 |
| 4,082,588 | 4/1978 | Anderton | 156/71 |
| 4,323,599 | 4/1982 | Marshall | 427/181 |
| 4,329,277 | 5/1982 | Murphy | 523/122 |
| 4,375,199 | 3/1983 | Graeme-Barber et al. | 144/222 |
| 4,410,642 | 10/1983 | Layton | 523/122 |
| 4,480,011 | 10/1984 | Durand | 428/474.4 |
| 4,603,653 | 8/1986 | Bews | 116/209 |
| 4,751,113 | 6/1988 | Riccio | 427/409 |
| 4,814,227 | 3/1989 | Maeda | 156/71 |
| 4,820,748 | 4/1989 | Yamamori | 525/175 |
| 4,895,881 | 1/1990 | Bigner | 523/122 |
| 4,923,730 | 5/1990 | Taniguchi | 428/907 |
| 5,044,293 | 9/1991 | Andoe | 114/222 |
| 5,354,603 | 10/1994 | Errede | 422/6 |

OTHER PUBLICATIONS

Ferro (Advertisement) Unknown Date "Crystic Copper--Clad Powerboat Protection".

*Primary Examiner*—Daniel Stemmer
*Attorney, Agent, or Firm*—C. G. Nessler

[57] ABSTRACT

A 0.005–0.020 inch thick thermoplastic sheet containing 20–80 weight percent metal alloy biocide particulate, such as 50 micron copper powder, protects submarine structures from adhesion of flora and fauna. The sheet is isotropic and inelastically deformable in the plane of the sheet. The sheet is heated to form and adhere it to the ship hulls and the like. An intermediate lower melting point film and other aids are employed in the adhering step. Heating of the sheet prior to the adhering process minimizes liberation of environmentally harmful volatiles. The sheet is removable by heating, so the material may be recycled.

18 Claims, 1 Drawing Sheet

THERMOPLASTICS SHEETS FOR PROTECTING SUB-MARINE STRUCTURES

FIELD OF INVENTION

The invention relates primarily to the protection of submarine devices and structures, including ship bottoms, pilings, and pipelines by applying biocide containing materials to their surfaces.

BACKGROUND

Marine fauna have long troubled mariners. For example, teredos, commonly known as shipworms, attack and destroy wooden structures, including pilings and ship hulls. And, cirripedia, commonly known as barnacles, adhere to immersed structures of virtually any type or composition. When a ship or boat is encrusted with barnacles, more power and fuel consumption are required to propel the boat at a given desired speed. Such vessels typically have to be removed from the water to remove encrustrations, at great expense. On pilings and the like, encrustrations of barnacles can increase hydrodynamic load and damage people and things in the water which contact them. For pipelines and the like, barnacles impede flow of water. Flora, such as slimes, also adhere to the bottoms of vessels and the like, adversely affecting drag and seemingly provide hospitable conditions for the aforementioned kinds of fauna.

Shipworms are overcome in large and small vessels with the use of plastics and metals as hull materials. However, wood pilings remain vulnerable. From olden times, wood was protected by lead and copper sheathing, and they are still considered effective. However, lead is heavy. Copper sheet is costly and presents galvanic action with other (iron) ship parts. And, it is difficult to apply to contoured surfaces.

Thus, the problem of dealing with barnacles persists. The most preferred current method for boat and ship hulls is to apply an antifouling paint. The paint is applied as a liquid organic material that polymerizes in place. The paint contains a collodial suspension of very fine particulates, typically 0.2 micron particle size, comprising a toxin, or biocide. For example, tin and copper compounds have been included in linseed oil and substitutes in combination with volatile petroleum solvents.

Antifouling paints have several limitations. While they are readily applied, adverse field conditions can affect their adhesion. They are inherently thin and susceptible to abrasion and cavitation. Paint film thickness is inherently limited inasmuch as the material is applied as a liquid. Typical thickness is 0.003–0.007 inch. Because paint must have sufficiently low viscosity to enable spraying or brushing, the biocide particulate must be very fine—typically about one micron particle size. Coarse size particulate tends to settle out from the liquid during application. Mostly, paint makers seek a colloidal suspension. And, biocide particulate material choice is limited to those kinds of materials which can be made sufficiently small in a feasible manner. Typically the materials used in paints are friable oxides or metal-organic precipitates. Owing to the resultant low volume of biocide presented at the surface, paints by design gradually dissolve or wear to expose new biocide and keep the surface active. The foregoing factors mean that over time, often in less than a year, paints lose their protective ability. Barnacles grow on the submarine structure surface and scraping and repainting is needed.

Antifouling paints can present pollution problems, adversely affecting other living things than barnacles. Especially when there is a concentration of many vessels in a waterway, as in harbors and marinas, unacceptable concentrations of biocide can affect marine life away from the vessels, as the paints rapidly wear away.

Applying and removing paints both present problems in the context of the environmental and health awareness of recent times. Thus, hydrocarbon solvent containing paints are disfavored, and often substitutes are less convenient or much more costly. When residual paint must be removed, paint dusts, as from sanding or sandblasting hulls, must be captured. As a general proposition, paint is not recyclable to new coatings.

Copper metal and oxide powder has been included in vehicles other than paints for protection of surfaces. For example, Bigner U.S. Pat. No. 4,895,881 describes how a mixture of biocide copper powder and polymer powders are applied as a solvent or liquid dispersed coating. Commercially, copper powder has been included in epoxy resin coatings applied by brushing or spraying. However, in such kinds of systems there is a tendency for the larger particle size copper powder to settle out before application. And, the coatings are sensitive to adverse field conditions. Bews U.S. Pat. No. 4,603,653 discloses the use of a rubber sheet into which are embedded 0.5 mm and larger pieces of chopped copper wire. Graeme-Barber et al. U.S. Pat. No. 4,375,199 discloses adhering prefabricated polymer sheets containing partially exposed copper wire mesh to marine structures.

Other than paint, none of these prior techniques has found widespread appeal and in general they are not readily recyclable. Consequently, there is a continuing problem and need for better protection of hulls and other objects immersed in a marine environment.

SUMMARY

An object of the invention is to provide anti-fouling protection for submarine structures which is more durable, yet economic. Another object is to provide surface protection in a way which is relatively unsusceptible to environmental variables at the point of application. A further object is to provide a means of protecting structures which enables the use of comparatively large biocidal particulates. A still further object is to provide a means of protection which generates less environmental nuisance in application and removal than do paints, and one which lends itself to recylcing of materials.

In accord with the invention, a thermoplastic polymerized resin sheet containing a biocide particulate is applied to the surface of a submarine structure. While the biocide may be of any particle size, the character of the thermoplastic resin and method of application enable the use of a relatively large biocide particulate, making feasible the use of certain metals and alloys. One preferred biocide is about 50 micron average particle size copper or copper alloy. During use, the biocide particulates near the surface of the sheet are exposed to the surrounding water and thus inhibit the growth of marine flora and fauna. During application or removal there is negligible evolution of volatile substances which are harmful to the environment, since such compounds are removed from the sheet during the sheet fabrication process in the factory.

In one embodiment, the sheet is 0.005–0.020 inch thick polyurethane, formed by extrusion after uniformly mixing into hot resin 20–80 weight percent spherical copper metal particulate. The sheet is pliable and may be permanently elongated, typically with the aid of heat, so it fits well contoured surfaces and adjacent sheets. Should the biocide become depleted or the sheet otherwise become worn after use, the sheet is mechanically removable, to be recycled as thermoplastic sheet or other product.

The sheet is inelastically elongatable in the plane of the sheet, having the nominal strength and character of the essential thermoplastic material; and, strength and other mechanical properties of the sheet in the region having particulate are essentially isotropic.

The sheet is adhered to the surface of the structure being protected by direct adherence, a bonding medium, or other means. In one embodiment, a lower melting point film is applied to the surface of the sheet before the sheet is contacted with the submarine structure, and the sheet and structure are then heated to bond the sheet to the structure. In other embodiments, different intermediate film layers used, for instance, to inhibit conduction, or to promote galvanic protection.

The invention provides a protective coating with better wear properties than paint. The thickness is greater and the abrasion resistance is greater. The sheet and method of applying avoid environmental problems associated with paints and aid recycling. Prefabrication of the sheet lessens coating quality problems and enables the use of the large particulates. The use of larger particulate provides both flexibility in choice of better biocidal materials that provide longer biocidal protection for the structure. The use of particulate instead of wire mesh enables a wider choice of materials. Further, the sheet of the invention may be readily and permanently extended in the plane of the sheet, to facilitate installation, since the particulate biocide form does not inhibit such.

The foregoing and other objects, features and advantages of the invention will become more apparent from the following description of the best mode of the invention and accompanying drawings.

DESCRIPTION

The invention is described in terms of applying a coating to the hull of a metal boat. It will be understood that the coating is applicable to all sorts of materials and structures.

Figure 1:
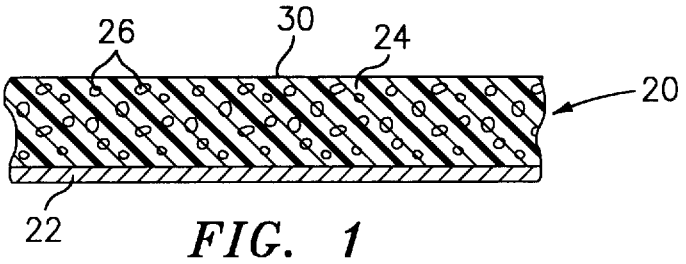
FIG. 1 is a schematic cross section of a polymer and biocide particulate sheet on the surface of a submarine structure being protected.

FIG. 1 is a schematic cross section illustrating the generality of the invention. Sheet 20 is mounted on the surface 22 of a structure being protected. The sheet is comprised of particulates 26 in matrix 24. The marine environment (water) contacts the free surface 30 of the sheet, where the particulates are exposed. The sheet may be directly adhered to the hull by sufficiently heating to melt the thermoplastic where it contacts the hull. More often, there will be a layer of some sort of adhesive material, as described below. Less desirably, mechanical fastening may be used.

A sheet of material suitable for application to the surface of the boat hull is formed in a factory by hot extrusion or other means commonly used for fabricating polyurethane resin into sheet. The particulate is uniformly dispersed in the heated, and thus comparatively low viscosity, resin prior to extrusion. After forming, the sheet is stored on reels, or as flats, as desired, until the time of application.

The material which is extruded is comprised of 20–80 weight percent biocide particulate, more preferably 40–60 weight percent. Preferably, the biocide is a metal or metal alloy, for example, copper. The preferred biocide particulate has an average particle size greater than one micron, and one which is substantially greater than the size commonly associated with paints. Preferably, the average particle size is greater than 15 microns, more preferably 5–150 microns. Sizes up to 500 microns are contemplated. Spherical metal particulate is preferred.

Compared to paints, the larger particle size means that the particles exposed at the surface of the sheet have greater volume and will take longer to become biochemically depleted. Thus, there will be comparatively little need for removal of matrix during use, in order to expose fresh biocide material, as is inherent and must be the case with paints. Nonetheless, in the invention, particulates which are common in paints of the prior art may be used when this feature of the invention is not sought.

The sheet thickness preferably is 0.005–0.150 inch, more preferably 0.005–0.020 inch. The upper ends of the ranges are thicknesses which are not obtainable by single layers of paints. The lower ends of the ranges just given will be characteristic of some paints, where the typical thickness of a single layer will be 0.003–0.007 inch. But, even when applied in a thickness approaching that of a paint, the invention will give better results because the properties of the matrix material are superior.

In one example of the practice of the invention, about 40 weight percent polyurethane resin, such as HM2103 resin (H. B. Fuller Co., St. Paul, Minn.) is blended while heating at about 300° F. with 60 weight percent Alcan 165 copper particles (Alcan Powders & Pigments Co, Union City, N.J.). The 99% copper has a 50 micron average particle diameter and is 90 weight percent less than 100 microns. After the powder is uniformly mixed in the resin, the heated mixture is extruded to form the sheet, and allowed to cool.

To apply the sheet to a hull, the hull is cleaned, as by sandblasting or other means suitable to its character, and made dry. Sheet is cut to suit the shape of the hull and the installer's desire. During application, heating of the sheet, as by hot air or thermal radiation, can be used to make the sheet more pliable and to enable easy permanent, plastic or inelastic, elongation in the plane of the sheet, to better fit the contours of the hull, or mate with adjacent sheets. In contrast, rubber type sheets only elastically elongate; thermoset sheets are brittle and cannot be substantially elongated; and, thermoplastic sheets with wire meshes are not elongatable within the meaning of this specification, since undue force would be required to deform the metal of the mesh that inherently strengthens the sheet, compared to a particulate.

In another aspect of the invention, the sheet has mechanical properties, such as compressive, tensile and shear strengths, associated elongations, and thermal properties, which are essentially isotropic in the portions of the sheet where the biocide material is present. This is in contrast to a sheet which contains wire mesh or chopped fibers, where, for example, strength will be different in one or both of the planar directions compared to the direction perpendicular to the plane of the sheet. Any reference within the meaning of this specification to the properties of the sheet containing particulate refers to that region of a sheet which actually contains particulate, as contrasted with contiguous portions of the sheet where particulates may be intentionally absent, such as in examples described below where the layer of the sheet adjacent the structure surface is free of particulate.

Adjacent pieces of sheet may be overlapped, one on the other, to achieve good coverage and to lessen any lifting of the edges during use. For example, the hull will be coated from the stern to the bow, so that a sheet nearer the bow will overlay—and protect from lifting—the leading edge of the sheet which is astern. Likewise, sheets may overlap one another, progressing vertically upward, as characterizes lap-streak hull construction.

In one method of attaching sheet to the hull, suitable especially for relatively small areas, contact adhesive, such as Duro Contact Adhesive (Loctite Corporation, Cleveland, Ohio) will be applied to both the hull surface and the sheet; and, when the sheet is contacted with the hull a bond is formed by the adhesive. Other room temperature bonding adhesives may be used.

Figure 2:
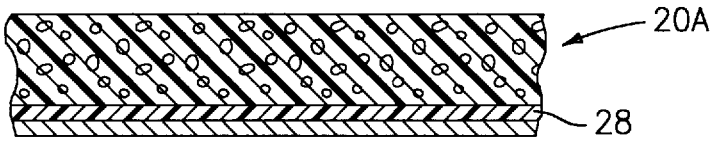
FIG. 2 is a schematic like FIG. 1 showing the addition of an intermediate adhesive film between the submarine structure and the sheet.

With reference to FIG. 2, another method of applying the sheet comprises providing a bonding film 28 of resin material between sheet 20A and the surface of the hull. Preferably, the film, which may be a monolithic thin sheet or a coating substance, is adhered to the sheet during factory fabrication. By design, the film 28 has a softening point temperature lower than that of the sheet. The hull surface, film and sheet are collectively or singly heated to a temperature sufficient to soften the film, so that upon cooling that film is adhesively bonded to the hull and the sheet.

For example, the sheet may be comprised of Bemis No. 3209 polyurethane resin, having a softening point of about 275° F., while the bonding film may be comprised of Bemis No. 3218 polyurethane resin, having a softening point of about 170° F. (Both resins are products of Bemis Associates, Shirley, Mass.) The hull and sheet-film combination are locally heated to a sufficient temperature, perhaps to as much as about 300° F., while the sheet and film are rolled or otherwise pressed firmly against the hull, so a strong bond is formed upon cooling. Various heating means may be used, such as convective or conductive heating from the hull interior, or inductive heating of a metal hull.

Figure 3:
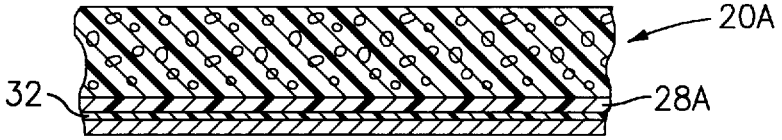
FIG. 3 is a schematic like FIG. 2 showing the use of a tack layer on the intermediate film.

To hold the sheet 20A and lower melting point film 28A combination in place prior to the heating and pressing step in the foregoing process, a tack layer 32 of still another resin may be used, as illustrated in FIG. 3. For example, a double surfaced pressure sensitive adhesive tape may be employed. As another example, a still lower softening point resin film may be used. Upon heating of the hull and sheet combination, permanent adhesion is obtained as the tack layer is amalgamated into the bonding film.

Either during the sheet fabrication process, or less preferably after the sheet is installed on the hull, the surface of the sheet which is to be exposed to the marine environment is burnished or abraded. The purpose is to remove some of the matrix from the sheet surface, to an extent sufficient to ensure that the biocide particulate will be sufficiently exposed to the marine environment during use, and not covered over by matrix material. For instance, the surface may be abraded with 80 or 100 grit sandpaper, or with a burnishing tool. When the abrading is done at a factory, the exposed particulate may be covered with a temporary film of soluble polymer or oil after abrading, to preserve it in its virgin condition during storage and handling. The thin protective film is removed after the sheet is adhered to the hull. It will also be appreciated that an advantage of the use of the lower melting point intermediate film described above is that without such remelting of the sheet during application could cause particulates exposed by abrasion at the factory to become submerged again in matrix.

The thermoplastic sheet of the invention, with or without bonding films or tack layers, is fabricated in a factory where quality control and environmental control are good. Typically, during manufacture of the sheet there are evolved some environmentally degrading vapors, commonly referred to as volatile organic compounds, or VOC's. They tend to be lubricants and additives, and small, low weight polymer molecules, all included in typical sheet material to aid formulation and fabrication, along with possible stray monomers. In the invention, the thermoplastic sheet is fabricated by first heating the resin and biocide mixture to an elevated temperature, for a time, and under an atmosphere (i.e, pressure and composition of gas in which the sheet is contained) sufficient to cause a substantial amount, a majority, of the volaltile materials to be carried away from the sheet, and they are handled by proper environmental control apparatuses associated with modern factories. Thus, when the sheet is re-heated during the sheet adhering step, there will insubstantial "environmentally unfriendly" evolution of volatile organic compounds (called VOC), in comparison to what occurs when petroleum solvent based paints are used, or if there was instead in-situ polymerization or creation of a sheet of material on the surface of a hull.

Because the sheet is made of thermoplastic, removal is readily accomplished, especially with aid of heating the sheet or structure, such as with torches, hot air streams, radiant heaters, etc. The sheet is pliable and is lifted from the surface using mechanical devices, such as scrapers, usually in increments, until the whole sheet protection system is removed. Because the material was initially applied as, and remains, thermoplastic, it may be recycled by reheating and refabrication as reconstituted sheets or as other products. The biocide in the sheet may also be recycled, to the extent it is not depleted. The sheet character and ease of removal also facilitates localized repairs.

In another aspect of the invention, an intermediate layer of dissimilar character material may be interposed between the sheet and the surface of the hull for purposes other than adhesion. For example, to improve the impermeability to moisture of the protective system, a 0.001–0.003 inch thick film of polyester may underlie the biocide containing sheet. As another example, for reducing galvanic effects when the hull is iron, a 0.005 inch thick film of galvanically sacrificial metal, such as aluminum or zinc, may be likewise placed. Suitable adhering techniques, in accord with the description above and prior art, are used to bind the dissimilar character films and thermoplastic sheet and hull. The metal film may of course be applied by metallizing or other suitable process.

In the generality of the invention, the sheet may be made of other thermoplastic resins than the preferred polyurethane. For instance, nylon, polyester, polyolefin and vinyl resins may be used. Similarly, the adhesive films mentioned above may be selected from such types of resins. Melt Index is a property of a plastic measured according to ASTM D1238, e.g., using an Extrusion Plastomer Model 987 testing machine (Tinius Olsen Testing Machine Co., Willow Grove, Pa.). High Melt Index indicates better propensity to flow. For the preferred unfilled resins of the invention, the Melt Index, measured at 190° C. will be 0.4 to 10 g/10 min. The class of adhesives commonly called "hot melt adhesives" may be used.

The sheet of the present invention is pliable at room temperature, compared to epoxy and other thermoset resins. Thus, it resists any tendency for cracking and flaking if the hull is struck or dented, or there is large temperature change. While the sheet of the invention is pliable, it is not elastic, as follows. When the sheet is stretched—typically by application of heat—it permanently elongates and there is no tendency as there is with an elastomer or rubber for the sheet to resume its original shape. With the absence of such tendency, there is less shear stress on the bond between the sheet and the hull than occurs with an elastomer.

The biocide may be any of the known materials used previously, including oxides and metal-organic compounds of copper and tin, or metals. Because paints require fine particle size to ensure dispersion in the liquid being applied, for economic reasons, the biocides of the prior art tended to predominately be friable materials, such as copper oxides, or precipitable as particulate, such as organotin. Since the invention enables the use of large particle sizes, it makes feasible the use of metal alloys which are typically only made by melting the metal, and then atomizing or otherwise disintegrating the metal. Thus, copper base alloys comprised of zinc, aluminum and chromium, or combinations thereof, may be used.

Usually, the particulates are dispersed uniformly in the thermoplastic sheet, as by mixing with plastic pellets prior to and during the extrusion process. Non-uniform dispersions are contemplated. They may be attained, for example, by imbedding particles into the surface of the thermoplastic sheet or by two-layer fabrication of the essential first resin thermoplastic sheet. Further, in the concept of the invention, when the aforementioned adhesives or films are used, the resultant total coating system on the structure is comprised of the sheet and films, plus any adhesive. While the coating may be an integral structure, the biocide is concentrated in the surface portion of the coating system.

The materials listed in Table 1 have shown good experimental results when used as biocide particulate in 0.010–0.015 inch polyurethane sheet submerged in seawater for weeks and months, where substantial barnacle and flora growth is observed on unprotected plastic and metal surfaces. All are commercial powders sold as ASTM -80 mesh particle size. The Alcan 165 powder is mentioned above. The PW powders were commercially procurable from Pratt & Whitney, West Palm Beach, Fla. In addition, powders of commercial brass and bronze alloys, normally employed in marine applications, may be used.

TABLE 1

Biocide particulate providing good results in polyurethane sheet.

| Designation | Particle shape | Nominal Composition by Weight |
|---|---|---|
| Alcan 165 | irregular | 99% Cu |
| PW 727 | round | 99% Cu |
| PW 653 | round | 97.7 Cu, 1 Cr, 1.3 Zn |
| PW 731 | round | 98.8 Cu 0.2 A1 |

The use of sheet on wood and other porous materials, such as may be used for pilings and the like, will be advantageous since sheet will bridge crevices and holes better than paints, thus improving protection against submarine fauna.

Although only the preferred embodiment has been described with some alternatives, further changes in form and detail may be made without departing from the spirit and scope of the claimed invention.

We claim:

1. A method of inhibiting marine growth on a structure exposed to a submarine environment which comprises:

forming a sheet having a portion comprised of a biocide particulate having an average particle size diameter of greater than 5 microns dispersed in a polymerized first resin which is thermoplastic; the sheet portion having isotropic mechanical properties and being inelastically elongatable within the plane of the sheet;

adhering the sheet to the surface of the structure in combination with stretching the sheet to thereby permanently elongate the sheet in the plane of the sheet, to provide a barrier to the submarine environment;

wherein, a portion of the biocide particulate in the sheet is exposed to the submarine environment.

2. The method of claim 1 wherein the sheet is comprised of 20–80 weight percent of biocide particulate having a particle size in the range 5–150 microns, balance resin.

3. The method of claim 1 wherein the biocide is comprised of metal selected from the group consisting of copper, zinc, aluminum, chromium, and alloys thereof.

4. The method of claim 1 wherein the first resin is selected from the group comprised of polyurethane, nylon, polyester, polyolefin, and vinyl resins and combinations thereof.

5. The method of claim 4 wherein the resin has a melt index of 0.4–10 g/10 minutes at 190° C.

6. The method of claim 1 wherein the first resin is polyurethane and the particulate is a metal comprised of copper.

7. The method of claim 1 which further comprises removing some of the first thermoplastic resin from the surface of the sheet after the sheet is adhered to the surface of the structure, to increase the exposure of portions of the biocide particulate to the submarine environment.

8. The method of claim 1 which further comprises removing some of the first thermoplastic resin from the surface of the sheet after the sheet is formed but before the step of adhering it to the structure, to increase the exposure of portions of the biocide particulate to the submarine environment.

9. The method of claim 8 which further comprises coating the biocide particulate with a temporary protective film after the step of exposing, and removing the temporary protective film after the sheet is adhered to the structure.

10. The method of claim 1 which further comprises removing the sheet, after a period of use in a submarine environment, by heating the sheet to an elevated temperature and mechanically lifting the sheet from the surface; and, recycling the first resin as a thermoplastic, for further use.

11. The method of claim 1 wherein the structure has a surface comprised of a first metal, which further comprises providing on the surface of the structure a layer of second metal which is galvanically sacrifical to the first layer, to underlie the sheet when it is adhered to the surface of the structure.

12. The method of claim 1 wherein the structure has a surface comprised of a metal, which further comprises interposing a layer of non-conductive organic material between the surface of the structure and said sheet, to minimize any galvanic activity between the particulates of the sheet and the structure.

13. The method of claim 12 wherein the layer of organic material is a second resin having less permeability to moisture than said first resin.

14. A method of inhibiting marine growth on a structure exposed to a submarine environment which comprises:

forming a sheet comprised of a biocide particulate having an average particle size diameter of greater than 5 microns dispersed in a polymerized first resin which is thermoplastic;

adhering the sheet to the surface of the structure using a layer of adhesive in the form of film of a polymerized second resin, the adhesive having a softening point lower than the softening point of the polymerized first resin; and, heating at least the second resin to a temperature sufficient to cause the second resin to adhere with an adhesive bond to the surface of the structure and the sheet;

wherein, a portion of the biocide particulate in the sheet is exposed to the submarine environment.

15. The method of claim 14, which further comprises:

attaching the film of second resin to the surface of the sheet prior to the step of adhering to the surface of the structure;

providing a film of third resin on the surface of said second resin film prior to the adhering step, the third resin having room temperature adhesive properties; and, contacting the sheet having the films of second and third resins with the surface of the structure, so that said sheet with said films is held in place by the third resin;

wherein, heating the second resin film causes interaction between the sheet, the third resin film, and the surface of the structure, to bond the sheet to the surface of the structure.

16. A method of inhibiting marine growth on a structure exposed to a submarine environment which comprises:

forming a sheet having a portion comprised of a uniformly dispersed biocide particulate dispersed in a polymerized first resin which is thermoplastic, wherein the resin is comprised of organic compounds which volatilize upon heating, wherein the forming process includes a first step of heating the sheet material under temperature, time and atmosphere sufficient to liberate a majority of the volatile organic compounds which comprise the resin;

wherein, the sheet portion comprises 20–80 weight percent metal particulate having an average particle size diameter in the range 5–150 micron, the sheet portion having isotropic mechanical properties and being inelastically elongatable within the plane of the sheet;

adhering the sheet to the surface of the structure by a process which includes placing the sheet in proximity to the surface of the structure, in combination with raising the temperature of the sheet by a second heating step;

inelastically elongating the sheet during the adhering step;

wherein, the combination of temperature, time and atmosphere during the second heating step is sufficient to liberate further amounts of said organic compounds;

wherein, a portion of the biocide particulate in the sheet is exposed to the submarine environment during use of the structure; and, removing the sheet, after a period of use in a submarine environment, by mechanically lifting the sheet from the surface; and, recycling the first resin as a thermoplastic.

17. The method of claim 16 wherein the sheet is subjected to a third heating step while the sheet is being removed from the structure.

18. A method of inhibiting marine growth on a structure exposed to a submarine environment which comprises:

forming a sheet having a portion comprised of a biocide particulate dispersed in a polymerized first resin which is thermoplastic, wherein the resin is comprised of organic compounds which volatilize upon heating; the sheet portion having isotropic mechanical properties and being inelastically elongatable within the plane of the sheet;

wherein, the sheet forming process includes a first heating step that subjects the sheet material to temperature, time and atmosphere sufficient to liberate a majority of the volatile organic compounds which comprise the resin;

adhering the sheet to the surface of the structure by a process which comprises re-heating the sheet, and stretching the sheet to thereby permanently elongate the sheet portion in the plane of the sheet;

wherein, a portion of the biocide particulate in the sheet is exposed to the submarine environment.

* * * * *